US006525999B1

(12) United States Patent
Shevins

(10) Patent No.: US 6,525,999 B1
(45) Date of Patent: Feb. 25, 2003

(54) WATCH WITH AN ILLUMINATED ORNAMENTAL DISPLAY SYSTEM

(76) Inventor: Herbert Shevins, 209 Gulf Blvd., Indian Rocks Beach, FL (US) 33758

( * ) Notice: Subject to any disclaimer, the term of this patent is extended or adjusted under 35 U.S.C. 154(b) by 0 days.

(21) Appl. No.: 09/976,587

(22) Filed: Oct. 15, 2001

(51) Int. Cl.[7] ..... G04B 19/00; G04B 19/04; G04B 37/00

(52) U.S. Cl. ..... 368/223; 368/228; 368/285

(58) Field of Search ..... 368/76, 80, 223, 368/228, 232, 276, 278, 285, 309; D10/123, 124, 31

(56) References Cited

U.S. PATENT DOCUMENTS

| | | | | |
|---|---|---|---|---|
| 1,446,082 A | | 2/1923 | Applegate | |
| 1,591,512 A | | 7/1926 | Chaiken | |
| 1,689,471 A | | 10/1928 | Andrusis | |
| 3,733,809 A | * | 5/1973 | Reiter et al. | 368/232 |
| 6,052,338 A | * | 4/2000 | Shevins | 368/223 |

FOREIGN PATENT DOCUMENTS

| | | | | |
|---|---|---|---|---|
| DE | 4139857 | * | 6/1993 | 368/223 |

* cited by examiner

*Primary Examiner*—Vit Miska
*Assistant Examiner*—Jeanne-Marguerite Goodwin

(57) ABSTRACT

A watch with an illuminated display comprises a case. The case has a bottom wall with an upstanding peripheral wall. A divider wall is provided between the walls to form a watch chamber and a display chamber. A timing assembly is provided in the watch chamber. The timing assembly has hands and a face. Also provided is an illuminatable ornamental display. The display may have any of a plurality of designs. The display has a rectangular base. The base is selectively received within the display chamber. A light source is provided beneath the base. Further provided are coupling components. The coupling components selectively position or remove the display. Last provided is a transparent crystal. The crystal is positioned over the upper face of the watch chamber. In this manner the face and hands of the watch are protected.

6 Claims, 2 Drawing Sheets

FIG 2
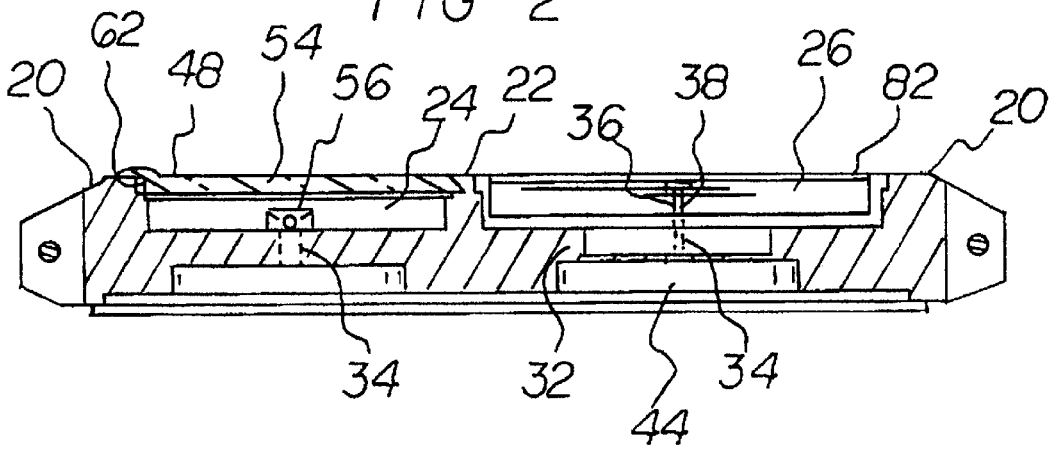
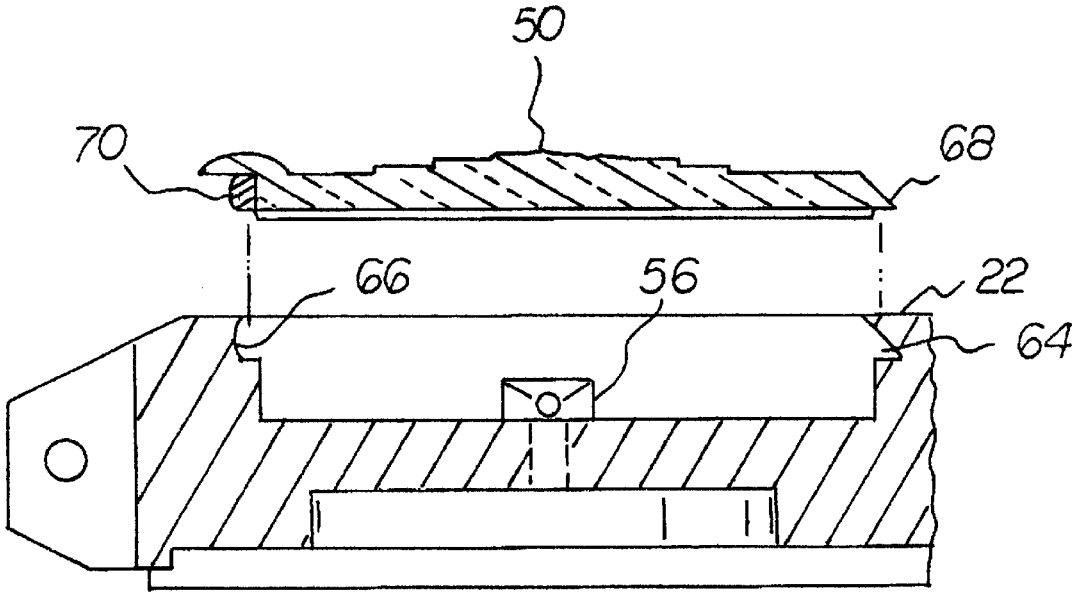
FIG 3

WATCH WITH AN ILLUMINATED ORNAMENTAL DISPLAY SYSTEM

BACKGROUND OF THE INVENTION

1. Field of the Invention

The present invention relates to a wristwatch with an illuminated ornamental display system and more particularly pertains to enhancing the readability and ornamental appearance of a watch.

2. Description of the Prior Art

The use of wristwatches with illuminatable components of known designs and configurations is known in the prior art. More specifically, wristwatches with illuminatable components of known designs and configurations previously devised and utilized for the purpose of enhancing the appearance of wristwatches through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,446,082 to Applegate discloses a combined locket and watch or clock. U.S. Pat. No. 1,591,512 to Chaiken discloses a wristwatch. U.S. Pat. No. 1,689,471 to Andrusis discloses an illuminated mirror, album and clock. Lastly, U.S. Pat. No. 6,052,338 to Shevins discloses a wristwatch with an illuminated ornamental display.

While these devices fulfill their respective, particular objectives and requirements, the aforementioned patents do not describe a wristwatch with an illuminated ornamental display system that allows enhancing the readability and ornamental appearance of a watch.

In this respect, the wristwatch with an illuminated ornamental display system according to the present invention substantially departs from the conventional concepts and designs of the prior art, and in doing so provides an apparatus primarily developed for the purpose of enhancing the readability and ornamental appearance of a watch.

Therefore, it can be appreciated that there exists a continuing need for a new and improved wristwatch with an illuminated ornamental display system which can be used for enhancing the readability and ornamental appearance of a watch. In this regard, the present invention substantially fulfills this need.

SUMMARY OF THE INVENTION

In view of the foregoing disadvantages inherent in the known types of wristwatches with illuminatable components of known designs and configurations now present in the prior art, the present invention provides an improved wristwatch with an illuminated ornamental display system. As such, the general purpose of the present invention, which will be described subsequently in greater detail, is to provide a new and improved wristwatch with an illuminated ornamental display system and method which has all the advantages of the prior art and none of the disadvantages.

To attain this, the present invention essentially comprises a case. The case has a bottom wall. The bottom wall is in a rectangular configuration. The case has long upstanding parallel side walls and short upstanding parallel end walls. A short upstanding divider wall is provided between the walls. An open top is provided. Two chambers are formed within. A watch chamber and a display chamber are also provided. The bottom wall has a disengagable periphery for releasably coupling with the remainder of the case. Provided next is an intermediate support plate. The support plate has a peripheral edge coupled to the interior of the side. End walls of the case are provided at an intermediate elevation with a circular opening in the center of each chamber. A timing assembly is provided next. The timing assembly has a container coupled with respect to the support plate beneath the opening of the watch chamber. Upstanding concentric rods extend through the circular opening. A long minute hand and a short hour hand are coupled to the rods above the support plate for the indication of time. A battery is removably received in the bottom of the timing assembly. The battery is accessible through the temporary removal of the bottom wall of the case. Provided next is a plurality of illuminatable ornamental displays. The ornamental displays including a cameo of a translucent material and a picture of a translucent material. Each display includes a rectangular base. The base is selectively received within the display chamber with a light source. The light is preferred to be a light emitting diode. The light source is coupled with respect to the support plate centrally beneath an ornamental display with a receptacle for removably supporting the light source with respect to the display. A battery is removably received in the bottom of the display chamber and accessible through the temporary removal of the bottom wall of the case. Next provided are removable coupling components. The coupling components position or remove a preselected display within the display chamber. Such coupling components including a V-shaped recess in the divider wall and an arcuate recess in the adjacent end wall. Each display has a V-shaped projection in one end edge. Each display further has an arcuate projection in the other end edge. Also provided is a rotatable stem. The stem has an interior end. The interior end is coupled with respect to the timing assembly and extends through a first side aperture in a side wall exterior end for the adjustment of the position of the hands. Further provided is an axially shiftable rod. The rod has an interior end. The interior end is coupled to the display assembly. The interior end of the rod further extends through a second side aperture in a side wall. An exterior end is adapted to be depressed by a user for activating the display assembly to illuminate the light source and transmit light through the display to the region adjacent to the upper surface of the support plate and the hands. Provided last is a transparent crystal. The crystal is positioned over the upper face of the watch chamber. In this manner the face and hands of the watch are protected.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wristwatch with an illuminated ornamental display system which has all of the advantages of the prior art wristwatches with illuminatable components of known designs and configurations and none of the disadvantages.

It is another object of the present invention to provide a new and improved wristwatch with an illuminated ornamental display system which may be easily and efficiently manufactured and marketed.

It is a further object of the present invention to provide a new and improved wristwatch with an illuminated ornamental display system which is of durable and reliable constructions.

An even further object of the present invention is to provide a new and improved wristwatch with an illuminated ornamental display system which is susceptible of a low cost of manufacture with regard to both materials and labor, and which accordingly is then susceptible of low prices of sale to the consuming public, thereby making such wristwatch with an illuminated ornamental display system economically available to the buying public.

Even still another object of the present invention is to provide a wristwatch with an illuminated ornamental display system for enhancing the readability and ornamental appearance of a watch.

Lastly, it is an object of the present invention to provide a new and improved watch with an illuminated display having a case. The case has a bottom wall with an upstanding peripheral wall. A divider wall is provided between the walls to form a watch chamber and a display chamber. A timing assembly is provided in the watch chamber. The timing assembly has hands and a face. Also provided is an illuminatable ornamental display. The display may have any of a plurality of designs. The display has a rectangular base. The base is selectively received within the display chamber. A light source is provided beneath the base. Further provided are coupling components. The coupling components selectively position or remove the display. Last provided is a transparent crystal. The crystal is positioned over the upper face of the watch chamber. In this manner the face and hands of the watch are protected.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is cross-sectional view taken along line 2—2 of FIG. 1.

FIG. 3 is an enlarged exploded cross-sectional view of the ornamental display, a cameo in this alternate embodiment, illustrating its coupling to the case.

The same reference numerals refer to the same parts throughout the various Figures.

DESCRIPTION OF THE PREFERRED EMBODIMENT

Figure 1:
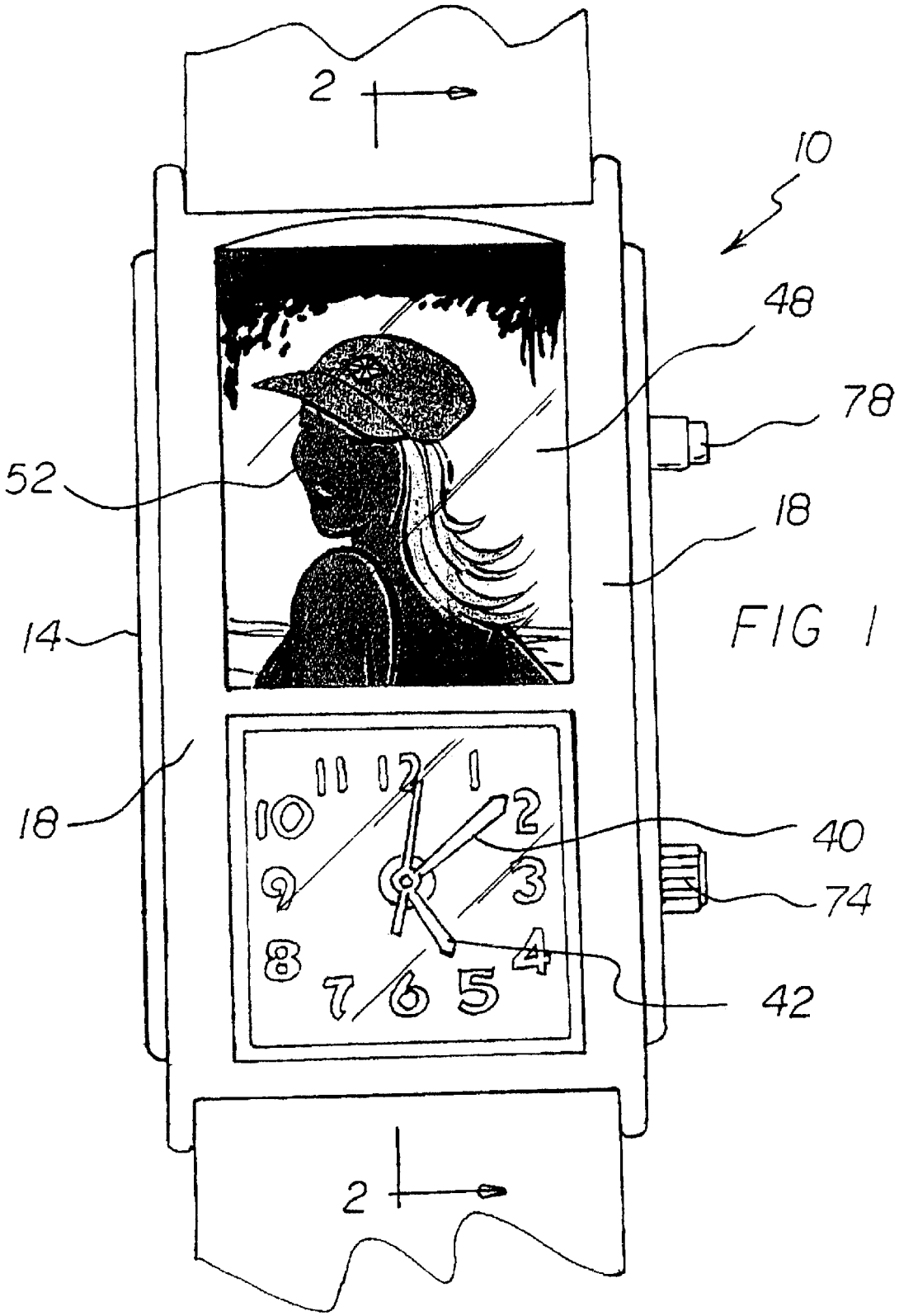
FIG. 1 is a front elevational view of a wristwatch with an illuminated ornamental display system constructed in accordance with the principles of the present invention.

With reference now to the drawings, and in particular to FIG. 1 thereof, the preferred embodiment of the new and improved wristwatch with an illuminated ornamental display system embodying the principles and concepts of the present invention and generally designated by the reference numeral 10 will be described.

The present invention, the wristwatch with an illuminated ornamental display system 10 is comprised of a plurality of components. Such components in their broadest context include a case, a timing assembly, an illuminatable ornamental display, coupling components and a transparent crystal. Such components are individually configured and correlated with respect to each other so as to attain the desired objective.

First provided is a case 14. The case has a bottom wall 16. The bottom wall is in a rectangular configuration. The case has long upstanding parallel side walls 18 and short upstanding parallel end walls 20. A short upstanding divider wall 22 is provided between the walls. An open top is provided. Two chambers are formed within. A watch chamber 24 and a display chamber 26 are also provided. The bottom wall has a disengagable periphery 28 for releasably coupling with the remainder of the case.

Provided next is an intermediate support plate 32. The support plate has a peripheral edge coupled to the interior of the side. End walls of the case are provided at an intermediate elevation with a circular opening 34 in the center of each chamber.

A timing assembly 36 is provided next. The timing assembly has a container coupled with respect to the support plate beneath the opening of the watch chamber. Upstanding concentric rods 38 extend through the circular opening. A long minute hand 40 and a short hour hand 42 are coupled to the rods above the support plate for the indication of time. A battery 44 is removably received in the bottom of the timing assembly. The battery is accessible through the temporary removal of the bottom wall of the case.

Provided next is a plurality of illuminatable ornamental displays 48. The ornamental displays including a cameo 50 of a translucent material and a picture 52 of a translucent material. Each display includes a rectangular base 54. The base is selectively received within the display chamber with a light source 56. The light is preferred to be a light emitting diode. The light source is coupled with respect to the support plate centrally beneath an ornamental display with a receptacle for removably supporting the light source with respect to the display. A battery 58 is removably received in the bottom of the display chamber and accessible through the temporary removal of the bottom wall of the case.

Next provided are removable coupling 62 components. The coupling components position or remove a preselected display within the display chamber. Such coupling components including a V-shaped recess 64 in the divider wall and an arcuate recess 66 in the adjacent end wall. Each display has a V-shaped projection 68 in one end edge. Each display further has an arcuate projection 70 in the other end edge.

Also provided is a rotatable stem 74. The stem has an interior end. The interior end is coupled with respect to the timing assembly and extends through a first side aperture in a side wall exterior end for the adjustment of the position of the hands.

Further provided is an axially shiftable rod 78. The rod has an interior end. The interior end is coupled to the display assembly. The interior end of the rod further extends through a second side aperture in a side wall. An exterior end is adapted to be depressed by a user for activating the display assembly to illuminate the light source and transmit light through the display to the region adjacent to the upper surface of the support plate and the hands.

Provided last is a transparent crystal 82. The crystal is positioned over the upper face of the watch chamber. In this manner the face and hands of the watch are protected.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wristwatch with an illuminated ornamental display system comprising, in combination:

a case having a bottom wall in a rectangular configuration with long upstanding parallel side walls and short upstanding parallel end walls and a short upstanding divider wall there between and with an open top to form two chambers there within, a watch chamber and a display chamber, the bottom wall having a disengagable periphery for releasably coupling with a remainder of the case;

an intermediate support plate having a peripheral edge coupled to the interior of the side and end walls of the case at an intermediate elevation thereof with a circular opening in the center of the watch chamber and the display chamber;

a timing assembly having a container coupled with respect to the support plate beneath the opening of the watch chamber with upstanding concentric rods extending through the circular opening and with a long minute hand and a short hour hand coupled to the rods above the support plate for the indication of time and with a battery removably received in the watch chamber and accessible through the temporary removal of the bottom wall of the case;

a plurality of illuminatable ornamental displays including a cameo of a translucent material and a picture of a translucent material, each display including a rectangular base selectively received within the display chamber with a light source, preferable a light emitting diode, there beneath coupled with respect to the support plate centrally beneath an ornamental display with a receptacle for removably supporting the light source with respect to the display and with a battery removably received in the display chamber and accessible through the temporary removal of the bottom wall of the case;

removable coupling components to position or remove a preselected display within the display chamber, such coupling components including a V-shaped recess in the divider wall and an arcuate recess in the adjacent end wall and with each display having a V-shaped projection in one end edge and an arcuate projection in the other end edge;

a rotatable stem having an interior end coupled with respect to the timing assembly and extending through a first side aperture in a side wall there adjacent and with an exterior end for the adjustment of the position of the hands;

an axially shiftable rod having an interior end coupled to the display assembly and extending through a second side aperture in a side wall and with an exterior end adapted to be depressed by a user for activating the display assembly to illuminate the light source and transmit light through the display to the region adjacent to the upper surface of the support plate and the hands; and a transparent crystal positioned over the upper face of the watch chamber to protect the face and hands of the watch.

2. A watch with an illuminated display comprising:

a case having a bottom wall with an upstanding peripheral wall and an upstanding divider wall there between and with an open top to form a watch chamber and a display chamber;

a timing assembly with hands and a face within the watch chamber;

an illuminatable ornamental display, with any of a plurality of designs, and with a rectangular base selectively received within the display chamber and coupleable to the peripheral wall and divider wall and with a light source there beneath;

coupling components to selectively position or remove the display within the display chamber; and a transparent crystal positioned over the upper face of the watch chamber to protect the face and hands of the watch.

3. The system as set forth in claim 2 wherein the display is a translucent cameo.

4. The system as set forth in claim 2 wherein the display is a translucent picture.

5. The system as set forth in claim 2 wherein the light source is a light emitting diode.

6. The system as set forth in claim 2 wherein the watch is a wristwatch.

* * * * *